US009113706B1

(12) United States Patent
Cannon

(10) Patent No.: US 9,113,706 B1
(45) Date of Patent: Aug. 25, 2015

(54) MOVEABLE STACKABLE RECYCLING BIN SYSTEM

(76) Inventor: Janie H. Cannon, Concord, NC (US)

( * ) Notice: Subject to any disclaimer, the term of this patent is extended or adjusted under 35 U.S.C. 154(b) by 240 days.

(21) Appl. No.: 13/595,236

(22) Filed: Aug. 27, 2012

(51) Int. Cl.
*A47B 87/00* (2006.01)
*A47B 87/02* (2006.01)

(52) U.S. Cl.
CPC ..... *A47B 87/007* (2013.01); *A47B 87/0276* (2013.01)

(58) Field of Classification Search
CPC .. A47B 87/007; A47B 87/0276; A47B 47/00; A47B 46/005
USPC ..... 206/501; 220/23.2, 23.83, 23.86, 4.27, 220/503, 908, 909; 312/107, 108, 211; 49/400, 390; D34/7
See application file for complete search history.

(56) References Cited

U.S. PATENT DOCUMENTS

| | | | | | |
|---|---|---|---|---|---|
| 1,361,562 | A | * | 12/1920 | Bekkering | 312/119 |
| 1,573,254 | A | * | 2/1926 | Lachaine | 312/108 |
| 2,593,998 | A | * | 4/1952 | Dupuis | 206/509 |
| 2,715,559 | A | * | 8/1955 | Villo | 312/107 |
| 2,895,782 | A | * | 7/1959 | Fragale | 312/290 |
| 3,552,579 | A | * | 1/1971 | Simon et al. | 211/126.12 |
| 3,577,671 | A | * | 5/1971 | Woollett | 446/124 |
| 3,743,372 | A | * | 7/1973 | Ruggerone | 312/108 |
| 3,791,552 | A | * | 2/1974 | Hayes | 206/501 |
| 3,893,615 | A | * | 7/1975 | Johnson | 232/43.2 |
| 4,192,562 | A | * | 3/1980 | Bishoff et al. | 312/108 |
| 4,390,217 | A | * | 6/1983 | Wagner | 312/205 |
| 4,660,758 | A | * | 4/1987 | Tavel et al. | 232/43.2 |
| 4,682,699 | A | * | 7/1987 | Ertley | 211/85.19 |
| 4,715,572 | A | * | 12/1987 | Robbins et al. | 248/101 |
| 4,801,034 | A | * | 1/1989 | Sandomeno | 220/23.83 |
| 4,834,262 | A | * | 5/1989 | Reed | 220/495.09 |
| 4,893,722 | A | * | 1/1990 | Jones | 220/503 |
| 4,988,010 | A | * | 1/1991 | Pollak | 220/503 |
| 5,016,946 | A | * | 5/1991 | Reznikov et al. | 312/108 |
| 5,072,852 | A | * | 12/1991 | Smith et al. | 220/495.09 |
| 5,085,342 | A | * | 2/1992 | Strawder | 220/495.09 |
| D324,933 | S | | 3/1992 | Giacobe et al. | |
| 5,103,998 | A | | 4/1992 | Caro et al. | |
| 5,143,246 | A | | 9/1992 | Johnson et al. | |

(Continued)

FOREIGN PATENT DOCUMENTS

| | | | | |
|---|---|---|---|---|
| EP | 284059 A2 | * | 9/1988 | B65F 1/14 |
| EP | 444620 A1 | * | 9/1991 | B65F 1/14 |
| GB | 2128591 A | * | 5/1984 | B65D 21/02 |

OTHER PUBLICATIONS www.homedepot.com, Simplehuman Recycling Retainer, Feb. 28, 2012.

*Primary Examiner* — Fenn Mathew
*Assistant Examiner* — Chetan Chandra

(57) ABSTRACT

A stackable recycling system for trash segregation comprises a garbage bin for non-recyclable trash, a stackable recycling subsystem. The stackable recycling subsystem has a base recycling bin, a stackable recycling bin and a top recycling bin. All three recycling bins have the same base specifications such that they can be stacked and secured via a plural of joining clips connecting grooves disposed on the side surfaces of those recycling bins. The base recycling bin and stackable recycling bin have a front door which can be pivotably opened for the convenience of trash receiving. Both the stackable recycling subsystem and garbage bins have rollers such that they can function independently or joined together as a single unit.

1 Claim, 5 Drawing Sheets

(56) References Cited

U.S. PATENT DOCUMENTS

| | | | | | |
|---|---|---|---|---|---|
| 5,147,044 | A | * | 9/1992 | DiSesa, Jr. | 206/501 |
| 5,150,809 | A | * | 9/1992 | Leigh | 220/495.08 |
| 5,167,343 | A | * | 12/1992 | Winfrey et al. | 100/102 |
| 5,184,836 | A | * | 2/1993 | Andrews et al. | 280/79.5 |
| 5,190,183 | A | | 3/1993 | McNaughton et al. | |
| 5,192,121 | A | * | 3/1993 | Stutler | 312/212 |
| D335,730 | S | | 5/1993 | Tessner et al. | |
| 5,238,301 | A | * | 8/1993 | Brady | 312/328 |
| 5,275,490 | A | * | 1/1994 | Loebbert | 383/33 |
| 5,381,916 | A | * | 1/1995 | Strawder | 220/23.4 |
| 5,421,252 | A | * | 6/1995 | Reichel | 100/193 |
| 5,662,235 | A | * | 9/1997 | Nieto | 220/23.86 |
| 5,662,238 | A | * | 9/1997 | Sarno | 220/495.11 |
| 5,680,744 | A | * | 10/1997 | Kramedjian et al. | 53/447 |
| 5,690,217 | A | * | 11/1997 | Friday | 206/278 |
| 5,775,046 | A | * | 7/1998 | Fanger et al. | 52/590.1 |
| 5,871,114 | A | * | 2/1999 | Anderson et al. | 220/495.11 |
| 6,062,416 | A | * | 5/2000 | Smillie | 220/524 |
| 6,138,558 | A | * | 10/2000 | Harrington | 100/102 |
| 6,296,132 | B1 | * | 10/2001 | Pickler | 220/1.5 |
| 6,378,721 | B1 | * | 4/2002 | Williams | 220/495.08 |
| 6,568,555 | B1 | * | 5/2003 | LoCascio | 220/495.07 |
| 7,048,346 | B2 | * | 5/2006 | Saravis | 312/111 |
| 7,083,060 | B2 | * | 8/2006 | Pickler | 220/1.5 |
| 7,243,811 | B1 | * | 7/2007 | Ramsey et al. | 220/495.11 |
| 7,464,829 | B1 | * | 12/2008 | Koefelda et al. | 220/532 |
| D596,819 | S | | 7/2009 | Mancini | |
| 7,703,622 | B1 | | 4/2010 | Bynoe | |
| 7,988,008 | B2 | * | 8/2011 | Banik et al. | 220/254.3 |
| 8,141,481 | B2 | * | 3/2012 | Forbes | 100/233 |
| 8,342,461 | B2 | * | 1/2013 | Sutphen | 248/97 |
| 8,381,936 | B1 | * | 2/2013 | Blake | 220/500 |
| 8,418,874 | B2 | * | 4/2013 | Ahlgrim et al. | 220/543 |
| D693,155 | S | * | 11/2013 | Wu | D6/672 |
| 2004/0074907 | A1 | * | 4/2004 | Gardner | 220/495.11 |
| 2004/0217677 | A1 | * | 11/2004 | Durand et al. | 312/108 |
| 2006/0244348 | A1 | * | 11/2006 | Richied et al. | 312/108 |
| 2007/0108878 | A1 | * | 5/2007 | Chen | 312/257.1 |
| 2007/0132345 | A1 | * | 6/2007 | Lai | 312/265.4 |
| 2008/0074013 | A1 | * | 3/2008 | Ahlgrim et al. | 312/108 |
| 2009/0206711 | A1 | * | 8/2009 | Glenn | 312/108 |
| 2010/0019630 | A1 | * | 1/2010 | Leng | 312/107 |
| 2011/0074255 | A1 | * | 3/2011 | Ahlgrim et al. | 312/107 |
| 2011/0101830 | A1 | * | 5/2011 | Mallouk | 312/107.5 |
| 2012/0153782 | A1 | * | 6/2012 | Fraser | 312/109 |
| 2012/0175409 | A1 | * | 7/2012 | Mcnay et al. | 229/131.1 |
| 2012/0229006 | A1 | * | 9/2012 | Zalewski | 312/107 |
| 2013/0221814 | A1 | * | 8/2013 | Ahlgrim et al. | 312/108 |

* cited by examiner

FRONT VIEW

SIDE VIEW

MOVEABLE STACKABLE RECYCLING BIN SYSTEM

BACKGROUND OF THE INVENTION

The trash disposal is a common issue in modern society. Trash segregation is widely adopted to enhance recycling procedures. In public places such as shopping mall, trashing receiving spot are not always designed for trash segregation. Moreover, those trashing receiving sports are not moveable and the trash bag are becoming heavy thus increases the burden for the cleaning staff. Hence, there is a need for a moveable recycling bin, which can take segregated recycling trash and easy for the cleaning staff to dump the trash to the larger trash receiving spot.

The present invention features a moveable stackable recycling bin system. The system comprises a garbage bin for non-recyclable trash, a stackable recycling subsystem. The stackable recycling subsystem has a base recycling bin, a stackable recycling bin and a top recycling bin. All three recycling bins have the same base specifications such that they can be stacked and secured via a plural of joining clips connecting grooves disposed on the side surfaces of those recycling bins. The base recycling bin and stackable recycling bin have a front door which can be pivotably opened for the convenience of trash receiving. Both the stackable recycling subsystem and garbage bins have rollers such that they can function independently or joined together as a single unit.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
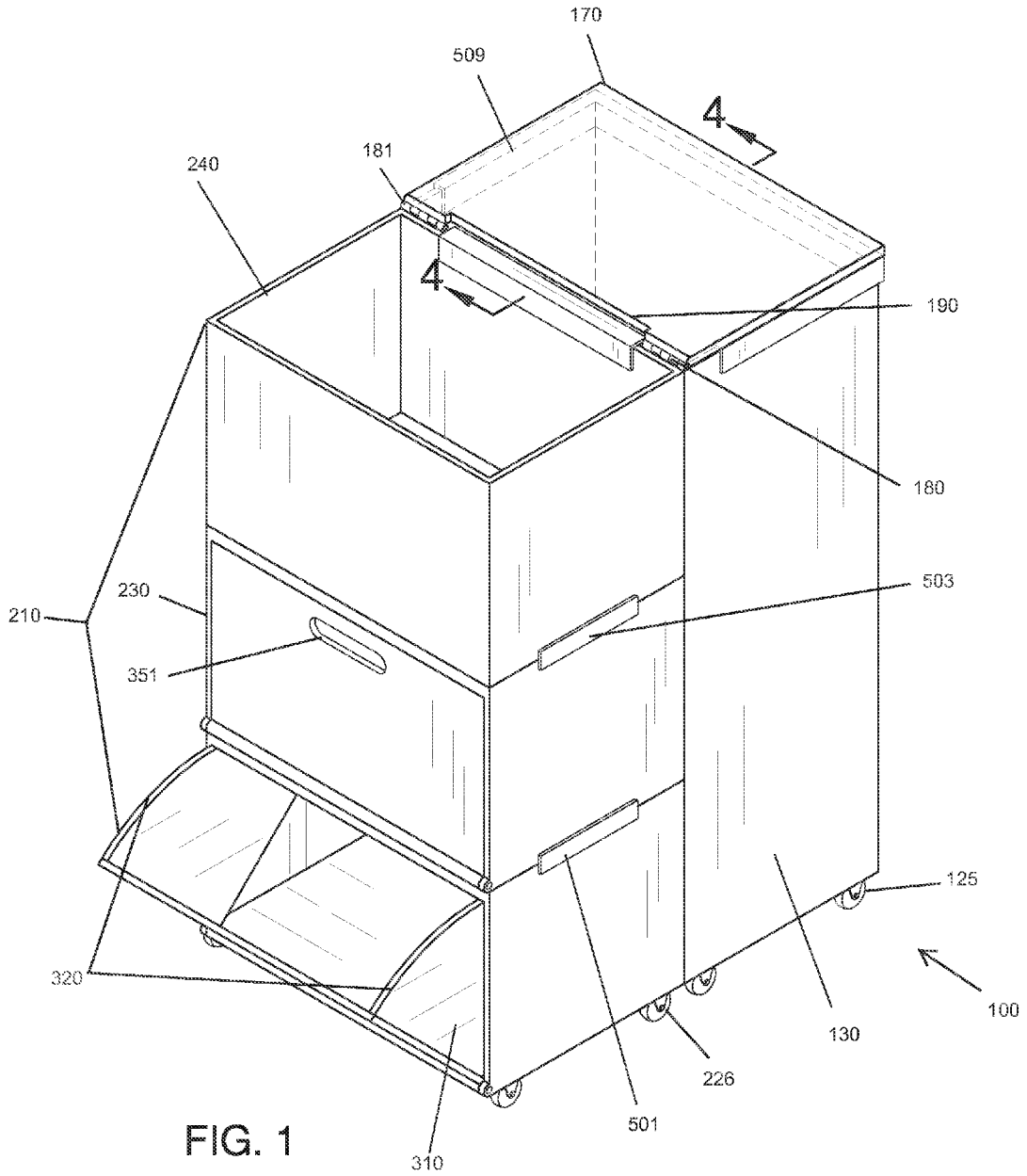
FIG. 1 shows an integrated view of the moveable stackable recycling bin system.
Figure 2:
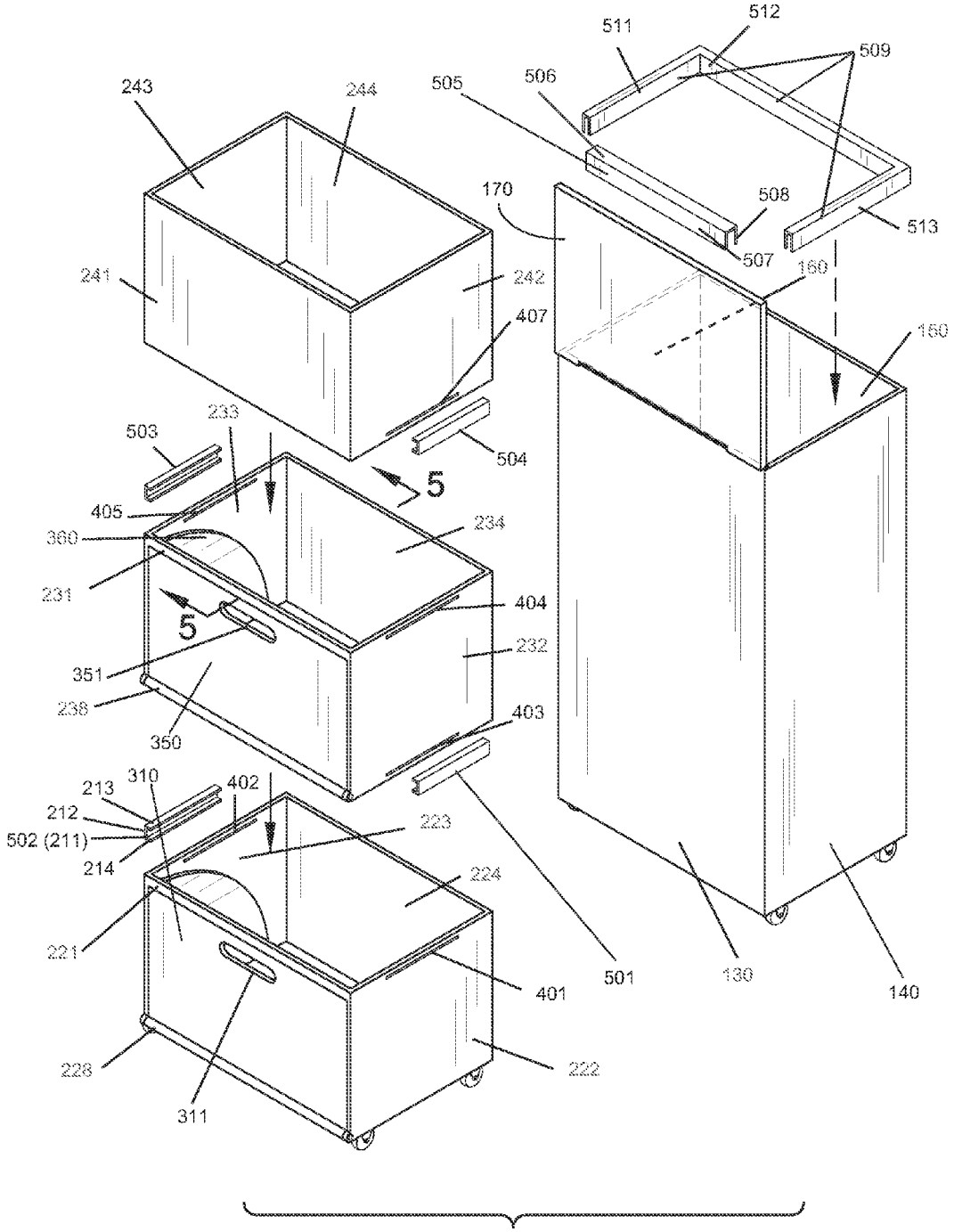
FIG. 2 shows a component view of the moveable stackable recycling bin system.
Figure 3:
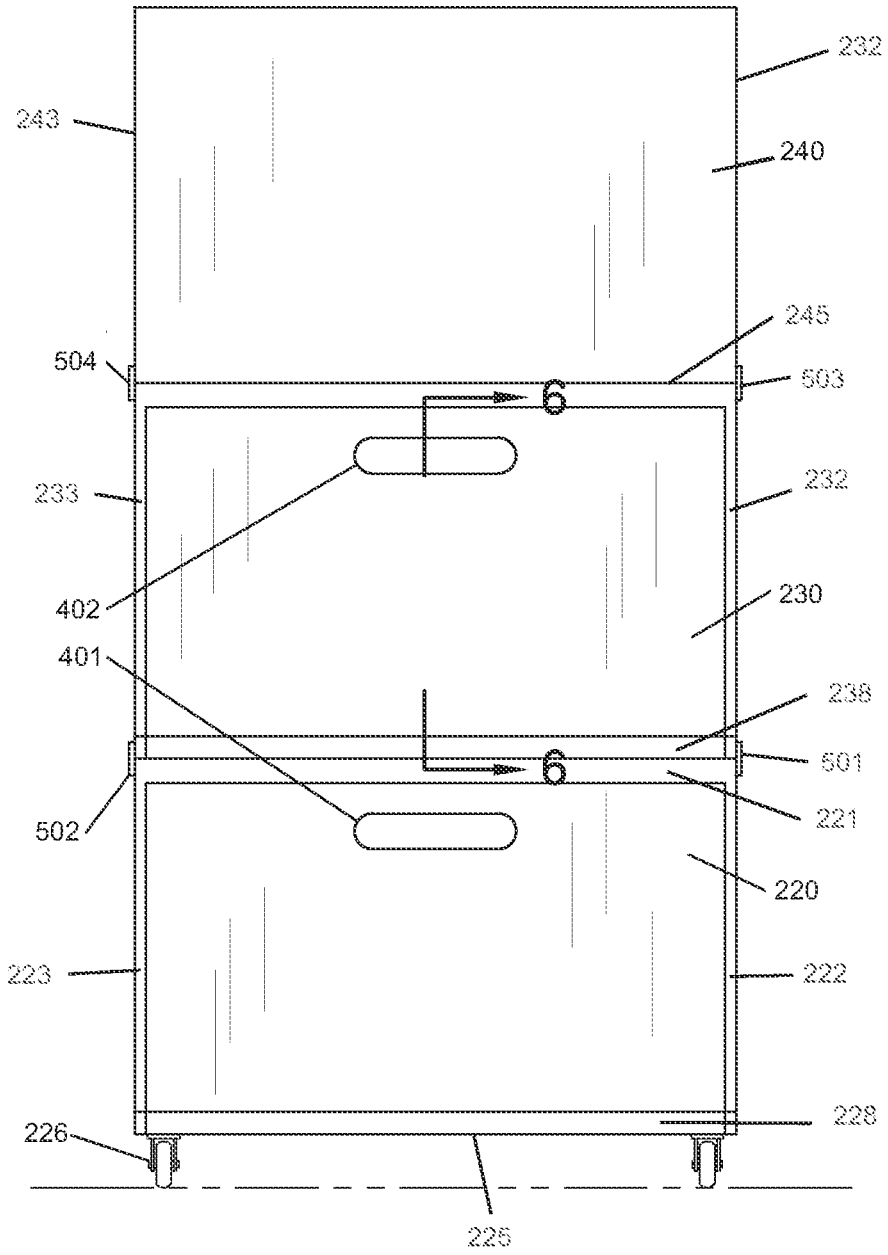
FIG. 3 shows a front view of the moveable stackable recycling bin system.
Figure 4:
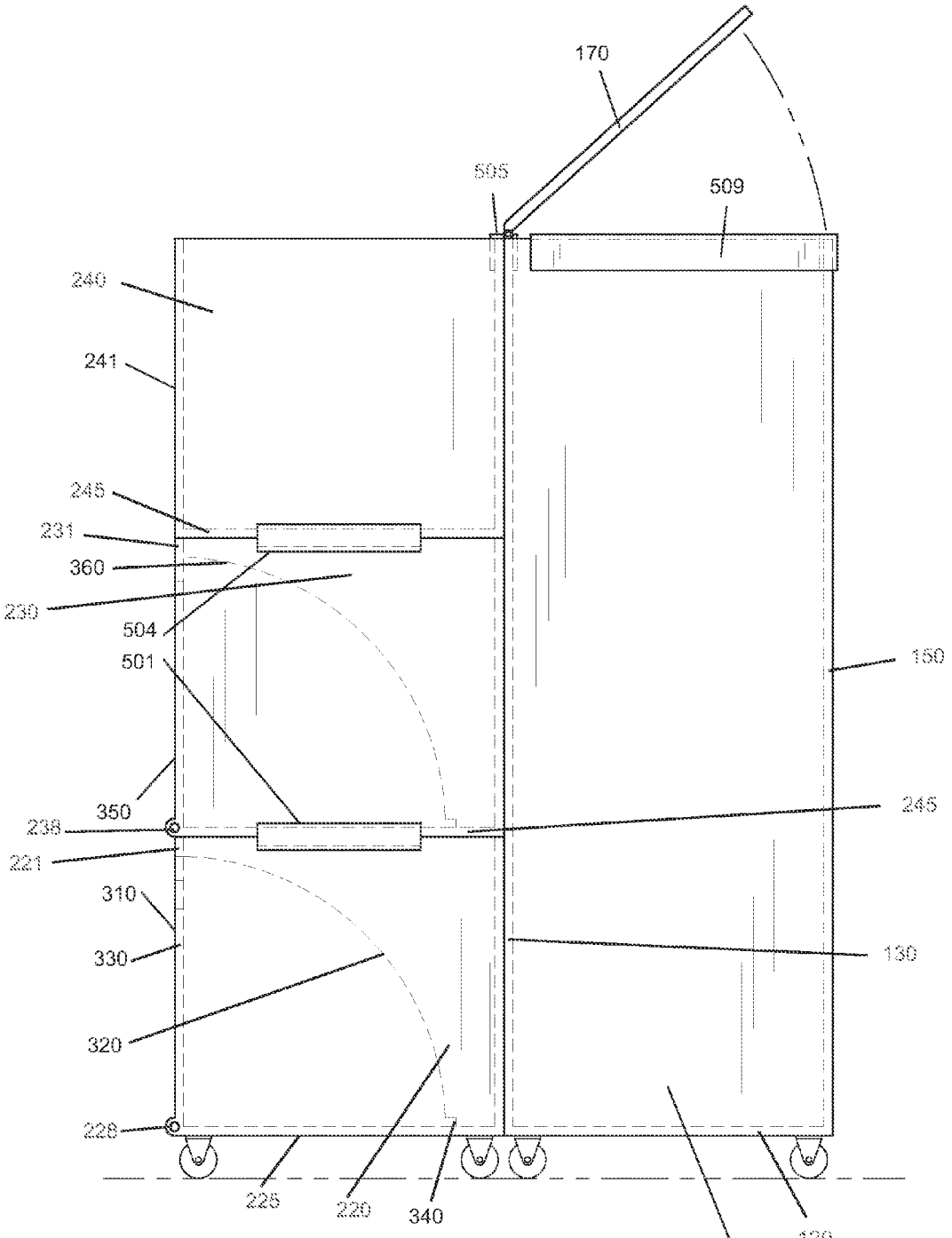
FIG. 4 shows a side view of the moveable stackable recycling bin system.
Figure 5:
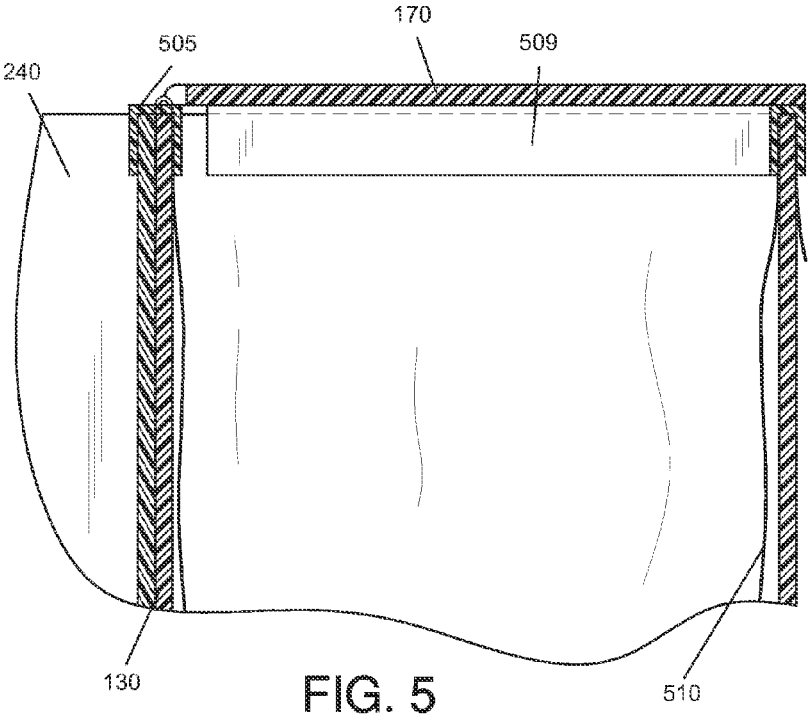
FIG. 5 shows a cross-section of the garbage bin with a garbage bag inside.
Figure 6:
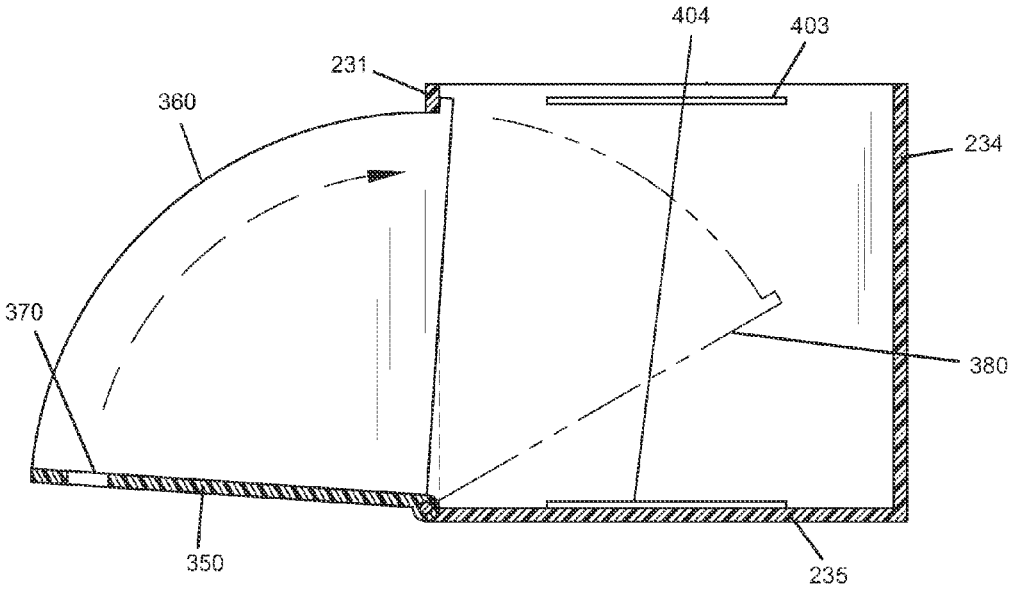
FIG. 6 shows a cross-section of the stackable recycling bin with front door open.

Referring now to FIG. 1-6, the present invention features a moveable stackable recycling bin system (100). The system includes a garbage bin 110 for non-recyclable trash, a stackable recycling subsystem (210). The stackable recycling subsystem has a base recycling bin (220), a stackable recycling bin (230) and a top recycling bin (240). All three recycling bins have the same base specifications such that they can be stacked and secured via a plural of joining clips connecting grooves disposed on the side surfaces of those recycling bins. The base recycling bin and stackable recycling bin have a front door which can be pivotably opened for the convenience of trash receiving. Both the stackable recycling subsystem and garbage bins have rollers such that they can function independently or joined together as a single unit.

The garbage bin is a hollow rectangle prism shape comprising a bottom surface (120), a first side surface (130), a second side surface (140) a third side surface (150), a fourth side surface (160) and a top opening, wherein a first set four rollers (125) are deposed at the four corners of the said bottom surface, wherein a lid (170) is pivotably connected to top edge of said first side surface through two hinges (180) and (181) to enable the lid to open or close, wherein a dent (190) is deposed on the edge of the said lid, wherein the edge between the two said hinges.

The base bin is a hollow rectangle prism shape comprising, a first side surface (221), a second side surface (222) a third side surface (223) and a fourth side surface (224), a bottom surface (225) and a top opening, wherein a second set of four rollers (226) are deposed at the four corners of the said bottom surface (225), wherein a first side (221) has a rectangle opening to fit in a first front door (310), wherein the first front door (310) is pivotably connected to bottom edge of the said first side surface (221) through a hinge (228), wherein the door have two side flanges (320) deposed on two ends of the inside surface of the said door, wherein the two flanges are the same with a sector shape and 90 degree arc angle; wherein the sector radius is the same as the height of the door, wherein the first edge (330) of the said sector connected with the inside surface of the said door, the second edge (340) has a length larger than the height of the first front door (310) such that the door is tilted to open until the side edge (340) touches the inside of the said first surface (221), wherein a first handle opening (311) slot is disposed near the top edge of the door, wherein a first groove (401) is disposed near the top edge of the said second side surface (222), a second groove (402) is disposed near the top edge of the said third side surface (223).

The stackable recycle bin is a hollow rectangle prism shape comprising a first side surface (231), a second side surface (232) a third side surface (233), a fourth side surface (234), a bottom surface (235) and a top opening, wherein a first side (231) has a rectangle opening to fit in a second front door (350), wherein the second front door (350) is pivotably connected to bottom edge of the said first side surface (231) through a hinge (238), wherein the second front door (350) have two side flanges (360) deposed on two ends of the inside surface of the said door, wherein the two flanges are the same with a sector shape and 90 degree arc angle; wherein the sector radius is the same as the height of the door, wherein the first edge (370) of the said sector connected with the inside surface of the said door, the second edge (380) has a length larger than the height of the said second front door (350) such that the door is tilted to open until the side edge (380) touches the inside of the said first surface (231), wherein a second handle opening slot (351) is disposed near the top edge of the door, wherein a third groove (403) is disposed near the top edge of the said second side surface (232), a fourth groove (404) is disposed near the bottom edge of the said second side surface (232); wherein a fifth groove (405) is disposed near the top edge of the said third side surface (233), a sixth groove (406) (not shown in Figures) is disposed near the bottom edge of the said third side surface (233).

The top recycling bin (240) is a hollow rectangle prism shape comprising a first side surface (241), a second side surface (242) a third side surface (243) and a fourth side surface (244), a bottom surface (245) and a top opening, wherein a seventh groove (407) is disposed near the bottom edge of the said second side surface (242), an eighth groove (408) (not shown in Figures) is disposed near the bottom edge of the said third side surface (243).

All the grooves of the base recycling bin (220), stackable recycle bin (230) and the top recycle bin (240) are the same specifications (length by width); wherein when stacked together, the distance between the top groove of any lower recycling bin and the bottom groove of immediate upper recycling bin are the same; wherein the base recycling bin (220), stackable recycle bin (230) and the top recycle bin (240) are stacked together via a plural of stack joining clips (211) with the same specifications; wherein each clip comprising a rectangle base (212), a top rectangle flange (213) and bottom flange (214) wherein two flanges are the same; wherein the base (212) and flanges have the same width and the width is equal to the groove width; wherein both flanges have a length equal to the depth of the grooves; wherein the length of the base (212) is equal to the distance between the top groove of any lower recycling bin and the bottom groove of immediate upper recycling bin; wherein the base recycling bin (220) and stack recycling bin (230) are stacked and secured with a first clip (501) connecting the first groove (401) and fourth groove (404), a second (502) clip connecting the second groove (402) and sixth groove (406); wherein the stack recycling bin (240) and top recycling bin (240) are stacked and secured with a third (503) clip connecting the third groove (403) and fifth groove (505) and a fourth clip (504) connecting the fourth groove (404) and sixth groove (506).

The stackable recycling bin subsystem (210) is removably connected to the garbage bin (110) via a joining clip (505); wherein the garbage bin (110) has the same height as the total height of the stackable recycling bin subsystem (210), wherein the joining clip (505) has a rectangle base (506) and two identical flanges (507) and (508); wherein the base (506) and flanges (507-508) have the same width as the dent (190) width; wherein the clip (505) securely connects the top edge of the fourth side surface (244) of the top recycling bin (240) and the top edge of the first side surface (130) of garbage bin (110).

In some embodiments, the bottom side surface (120) of the garbage bin (110) has different specification as the bottom side surface (245) of the top recycling bin. In some embodiments, the bottom side surface (120) of the garbage bin (110) has same specification as the bottom side surface (245) of the top recycling bin and the lid (170) of garbage bin (110) is pivotably rotated around hinges (180) and (181) to function as lid for either the top recycling bin 240 or garbage bin (110) when the stackable recycling bin subsystem (210) is connected to the garbage bin (110).

In some embodiments, the base recycling bin (220), stackable bin (230), top recycling bin (240) are marked with signs for a first, second and third category of recycling trash. For example, the first, second and third categories of recycling trashes are for glass, metal and paper respectively. In some embodiments, the base recycling bin (220), stackable bin (230), top recycling bin (240) and the garbage bin (110) all have the same color, such as black. In some embodiments, the garbage bin (110) have the first color such as black, the base recycling bin (220), stackable bin (230), top recycling bin (240) all have the same color such as green. In some embodiments, the garbage bin (110) have the first color such as black, the base recycling bin (220), stackable bin (230) and top recycling bin (240) have different colors.

The garbage bin (110) and the stackable recycling bin subsystem (210) can be connected for a joint function such as carrying all the garbage to a regional garbage receiving spot, or separated for independent function such that the stackable recycling bin subsystem (210) is used for recycling items collecting and the garbage bin (110) is used for non-recyclable garbage collecting. The regional receiving spot includes but not limit to outside garbage station of shopping mall, restaurant, school, etc. The cleaning staffs can separate or combine the recycling bin subsystem (210) and garbage bin (110) according to theft own preference or the convenience of cleaning work.

In some embodiments, a plastic garbage bag is disposed inside the garbage bin (110) with or without secure means. The garbage bag can be securely tightened to the garbage bin (110) via the joining clip (505) and bag clip (509). The bag clip (509) can be any kind of clips, such as alligator clip, spring clip, etc. In some embodiments, the bag clip (509) is U-shape clip along the top edges of the second, third and fourth side surfaces of the garbage bin (110). The clip (509) has a first arm (511), a second arm (512) and third arm (513), wherein the first arm (511) has a length the same as the width of the second side surface (140) of garbage bin, wherein the second arm (512) has a length the same as the width of the third side surface (150) of garbage bin, wherein the third arm (513) has a length the same as the width of the fourth side surface (160) of garbage bin, wherein the U-shape clip has two flanges along all the arms, wherein with the distance between the flanges the same as the garbage bin wall thickness.

The garbage bin (110) has a typical volume ranging from about 32 to about 95 US gallons although it can be smaller or larger according to user preference.

As used herein, the term "about" refers to plus or minus 10% of the referenced number.

The disclosures of the following U.S. patents are incorporated in their entirety by reference herein: U.S. Pat. No. 5,190,183, U.S. Pat. No. 7,703,622, U.S. Design Pat. No. 324,933, U.S. Design Pat. No. 324,930, U.S. Design Pat. No. 596,819, U.S. Pat. No. 4,801,304, U.S. Pat. No. 5,103,988 and U.S. Pat. No. 5,143,246.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A stackable recycling system (100) consisting of:

(a) a garbage bin (110), wherein the garbage bin is a hollow rectangle prism shape consisting of a bottom surface (120), a first side surface (130), a second side surface (140) a third side surface (150), a fourth side surface (160) and a top opening, wherein a first set of four rollers (125) are disposed at four corners of the bottom surface, wherein a lid (170) is pivotably connected to top edge of the first side surface through two hinges (180) and (181) to enable the lid to open or close, wherein a dent (190) is disposed on an edge of the lid, wherein the edge of the lid is recessed back to form the dent (190), wherein the dent (190) is between the two hinges (180, 181), wherein a length of the dent (190) is the distance between the two hinges (180, 181), wherein the edge between the two said hinges; and (b) a stackable recycling bin subsystem (210), wherein the recycling bin subsystem consists of:

(i) a base recycling bin (220), wherein the base bin is a hollow rectangle prism shape consisting of a base first side surface (221), a base second side surface (222), a base third side surface (223), a base fourth side surface (224) and a base bottom surface (225) and a base top opening, wherein each roller of a second set of four rollers (226) is disposed at each corner of a four corners of the bottom surface (225), wherein the base first side surface (221) has a rectangle opening to fit in a first front door (310), wherein the first front door (310) is pivotably connected to bottom edge of the base first side surface (221) through a hinge (228), wherein the first front door (310) has two first front door side flanges (320) disposed on two ends of an inside surface of the first front door (310), wherein each first front door side flange (320) is in a shape of a first sector, wherein a first arc angle of the first sector is 90 degrees; wherein a first sector radius is the same as a height of the door, wherein a first edge (330) of each first front door side flange is connected to the inside surface of the first front door (310), a second edge (340) of each first front door side flange has a length larger than the height of the first front door (310) such that when the first front door (310) is tilted to open, the second edge (340) touches the base first surface (221), wherein when the first front door (310) is closed, the second edge (340) of each first front door side flange touches the base bottom surface (225), wherein a first handle opening slot (311) is disposed near a top edge of the first front door (310), wherein a first groove (401) is disposed near a top edge of the base second side surface (222), a second groove (402) is disposed near a top edge of the base third side surface (223);

(ii) a stackable recycle bin (230), wherein the stackable recycle bin is a hollow rectangle prism shape consisting of a stackable bin first side surface (231), a stackable bin second side surface (232) a stackable bin third side surface (233), a stackable bin fourth side surface (234), a stackable bin bottom surface (235) and a stackable bin top opening, wherein the stackable bin first side (231) has a rectangle opening to fit in a second front door (350), wherein the second front door (350) is pivotably connected to a bottom edge of the stackable bin first side surface (231) through a hinge (238), wherein the second front door (350) have two second front door side flanges (360) disposed on two ends of an inside surface of the second front door, wherein each second front door side flange (360) is in a shape of a second sector, wherein a second arc angle of the second sector is 90 degrees; wherein a second sector radius is the same as a height of the second front door, wherein a first edge (370) of the second front door side flange (360) is connected to the inside surface of the second front door, a second edge (380) of the second front door side flange (360) has a length larger than the height of the second front door (350) such that when the second front door (350) is tilted to open, the second side edge (380) touches the stackable bin first side surface (231), wherein when the second front door (350) is closed, the second edge (380) of each second front door side flange touches the stackable bin bottom surface (235), wherein a second handle opening (351) slot is disposed near a top edge of the second front door (350), wherein a third groove (403) is disposed near a top edge of the stackable bin second side surface (232), a fourth groove (404) is disposed near a bottom edge of the stackable bin second side surface (232); wherein a fifth groove (405) is disposed near a top edge of the third side surface (233), a sixth groove (406) is disposed near a bottom edge of the stackable bin third side surface (233);

(iii) a top recycle bin (240), wherein the top recycling bin is a hollow rectangle prism shape consisting of a top bin first side surface (241), a top bin second side surface (242) a top bin third side surface (243), a top bin fourth side surface (244), a top bin bottom surface (245) and a top bin top opening, wherein a seventh groove (407) is disposed near a bottom edge of the top bin second side surface (242), an eighth groove (408) is disposed near a bottom edge of the top bin third side surface (243);

wherein all the grooves of the base recycling bin (220), the stackable recycle bin (230) and the top recycle bin (240) have a same groove length and a same groove width, wherein when stacked together, a distance between the top groove of any lower recycling bin and the bottom groove of immediate upper recycling bin are the same; wherein the base recycling bin (220), the stackable recycle bin (230) and the top recycle bin (240) are stacked together via a plurality of stack joining clips (211) with the same specifications; wherein each clip consists of a rectangle base (212), a top rectangle flange (213) and a bottom flange (214), wherein the rectangle base (212), the top rectangle flange (213) and the bottom flange (214) have a same length, wherein the length is equal to the groove length, wherein the top rectangle flange (213) and the bottom flange (214) have a width equal to the groove width; wherein the height of the rectangle base (212) is equal to the distance between the top groove of any lower recycling bin and the bottom groove of immediate upper recycling bin; wherein the base recycling bin (220) and stack recycling bin (230) are stacked and secured with one clip of the stack joining clips connecting the first groove (401) and third groove (403), another clip of the stack joining clips connecting the second groove (402) and sixth groove (406); wherein the stack recycling bin (230) and top recycling bin (240) are stacked and secured with one clip of the stack joining clips connecting the third groove (403) and fifth groove (505) and another clip of the stack joining clips connecting the fourth groove (404) and sixth groove (506); and wherein the stackable recycling bin subsystem (210) is removably connected to the garbage bin (110) via a joining clip (505); wherein when the base recycling bin (220), the stackable recycle bin (230) and the top recycle bin are stacked together, the garbage bin (110) has a same height as a height of the stacked base recycling bin (220), the stackable recycle bin (230) and the top recycle bin, wherein the joining clip (505) has a joining clip rectangle base (506) and two joining clip flanges (507) and (508); wherein the joining clip rectangle base (506) and the joining clip flanges (507-508) have the same length as the dent (190) length; wherein a width of the dent (190) is sufficient for inserting one of the joining clip flanges into the dent (190), wherein the joining clip (505) securely connects top edge of the top bin fourth side surface (244) of the top recycling bin (240) and a top edge of the first side surface (130) of garbage bin (110).

* * * * *